US008339335B2

(12) United States Patent
Ogawa

(10) Patent No.: US 8,339,335 B2
(45) Date of Patent: Dec. 25, 2012

(54) ELECTROLUMINESCENCE DISPLAY APPARATUS AND METHOD OF CORRECTING DISPLAY VARIATION FOR ELECTROLUMINESCENCE DISPLAY APPARATUS

(75) Inventor: Takashi Ogawa, Gifu (JP)

(73) Assignee: Semiconductor Components Industries, LLC, Phoenix, AZ (US)

( * ) Notice: Subject to any disclaimer, the term of this patent is extended or adjusted under 35 U.S.C. 154(b) by 808 days.

(21) Appl. No.: 11/859,158

(22) Filed: Sep. 21, 2007

(65) Prior Publication Data

US 2008/0074358 A1 Mar. 27, 2008

(30) Foreign Application Priority Data

Sep. 21, 2006 (JP) ..... 2006-256123

(51) Int. Cl.
*G09G 3/30* (2006.01)

(52) U.S. Cl. ..... 345/76; 315/169.1; 315/169.4; 345/82; 345/204

(58) Field of Classification Search ..... 345/72, 345/78, 76, 87, 169.3, 169.1, 82–8, 204; 315/169.1, 169.4; 715/702, 800
See application file for complete search history.

(56) References Cited

U.S. PATENT DOCUMENTS 4,811,190 A 3/1989 Keir et al.
5,563,839 A 10/1996 Herdt et al.
5,990,629 A * 11/1999 Yamada et al. ..... 315/169.3
6,204,610 B1 * 3/2001 Komiya ..... 315/169.3
6,608,620 B1 * 8/2003 Suzuki et al. ..... 345/204
2002/0180721 A1 12/2002 Kimura et al.
2005/0179628 A1 * 8/2005 Kimura ..... 345/77
2005/0237318 A1 10/2005 Inoue et al.
2006/0066533 A1 * 3/2006 Sato et al. ..... 345/76

FOREIGN PATENT DOCUMENTS

JP 10-254410 A 9/1998
JP 2002-278513 A 9/2002
JP 2004-38209 A 2/2004
JP 2004-38210 A 2/2004
JP 2004-101767 A 4/2004
JP 2005-316408 11/2005
JP 2006-106122 A 4/2006
WO 98/40871 A1 9/1998

OTHER PUBLICATIONS

Notice of Grounds for Rejection for Patent Application No. 2006-256123 mailed on Nov. 30, 2010 with English translation.

* cited by examiner

*Primary Examiner* — Lun-Yi Lao
*Assistant Examiner* — Shaheda Abdin
(74) *Attorney, Agent, or Firm* — Cantor Colburn LLP

(57) ABSTRACT

By correcting a data signal based on a current flowing through an EL element when an element driving transistor which controls a drive current to be supplied to the EL element is operated in a saturation region and the EL element is set to an emission level, it is possible to realize a rapid display variation inspection and a high precision display variation correction. By providing a current measuring function on an EL display apparatus, a characteristic variation after the apparatus is shipped can be handled and corrected.

8 Claims, 6 Drawing Sheets

ELECTROLUMINESCENCE DISPLAY APPARATUS AND METHOD OF CORRECTING DISPLAY VARIATION FOR ELECTROLUMINESCENCE DISPLAY APPARATUS

CROSS-REFERENCE TO RELATED APPLICATIONS

The entire disclosure of Japanese Patent Application No. 2006-256123 including specification, claims, drawings, and abstract is incorporated herein by reference.

BACKGROUND OF THE INVENTION

1. Field of the Invention

The present invention relates to correction of a display variation of a display apparatus having an electroluminescence element in each pixel.

2. Description of the Related Art

Electroluminescence (hereinafter referred to as "EL") display apparatuses in which an EL element which is a self-emissive element is employed as a display element in each pixel are expected as a flat display apparatus of the next generation, and are being researched and developed.

After an EL panel is created in which an EL element and a thin film transistor (hereinafter referred to as "TFT") or the like for driving the EL element for each pixel are formed on a substrate such as glass and plastic, the EL display apparatus is subjected to several inspections and is then shipped as a product.

In a current active matrix EL display apparatus having a TFT in each pixel, a brightness unevenness occurs among the EL elements because of display unevenness caused by the TFT, in particular, a variation in the threshold value Vth of the TFT, which is a major cause of reduction in yield. An improvement in the yield of the products is very important, and, thus, reduction in the display defect and display unevenness (display variation) by improving an element design, a material, a manufacturing method, or the like is desired. Attempts have been made, for example, as described in JPA 2005-316408 (hereinafter referred to as "Reference Document 1"), in which, when a display unevenness or the like occurs, the display unevenness is corrected so that the panel is made a non-defective panel.

In the Reference Document 1, the EL panel is caused to emit light, the brightness of each pixel is measured, and a data signal (video signal) to be supplied to the pixel is corrected according to the variation in the brightness. In addition, as another method, a method is proposed in which a circuit which corrects the variation of Vth of an element driving transistor which controls a current to be supplied to the EL element is provided in each pixel.

In a structure in which the EL panel is caused to emit light and an image of the emission is captured with a camera in order to measure the brightness variation as described in the Reference Document 1, when a resolution of the EL panel is increased and a number of pixels in the EL panel is increased, a number of the measurement and correction target becomes large for measuring the brightness variation for each pixel, and, thus, an increase in the resolution of the camera, an increase in capacity of a storage of correction information, etc. is required.

Moreover, even when the circuit element for compensating Vth is not to be incorporated, it is highly desired to correct the display unevenness caused by the variation in Vth of TFTs.

SUMMARY OF THE INVENTION

An advantage of the present invention is that a display variation is accurately and efficiently measured for an EL display apparatus and the display variation can be corrected.

According to one aspect of the present invention, there is provided a method of correcting a display variation for an electroluminescence display apparatus, wherein the display apparatus comprises, in each pixel, an electroluminescence element having a diode structure and an element driving transistor which is connected to the electroluminescence element and which controls a current flowing through the electroluminescence element, an inspection ON display signal which sets the electroluminescence element to an emission level is supplied to each pixel, the element driving transistor is operated in a saturation region of the transistor, and a current flowing through the electroluminescence element is detected, and a data signal to be supplied to a corresponding pixel is corrected based on a value of the current flowing through the electroluminescence element.

According to another aspect of the present invention, there is provided an electroluminescence display apparatus comprising a display section having a plurality of pixels, a correction data storage section which stores correction data for correcting a display variation, and a correction section which corrects the display variation, wherein each of the plurality of pixels comprises an electroluminescence element and an element driving transistor which is connected to the electroluminescence element, the correction data storage section stores correction data corresponding to a current flowing through the electroluminescence element when an inspection ON display signal which sets the electroluminescence element to an emission level is supplied, and the correction section corrects a data signal to be supplied to each pixel based on the correction data.

According to another aspect of the present invention, there is provided an electroluminescence display apparatus comprising a display section having a plurality of pixels, a correction data storage section which stores correction data for correcting a display variation, and a correction section which corrects the display variation, wherein each of the plurality of pixels comprises an electroluminescence element and an element driving transistor which is connected to the electroluminescence element, the correction data storage section stores correction data corresponding to an ON-OFF current difference between a current flowing through the electroluminescence element corresponding to an inspection OFF display signal which sets the electroluminescence element to a non-emission level and a current flowing through the electroluminescence element corresponding to an inspection ON display signal which sets the electroluminescence element to an emission level when the inspection OFF display signal and the inspection ON display signal are supplied, and the correction section corrects a data signal to be supplied to each pixel based on the correction data.

According to another aspect of the present invention, there is provided an electroluminescence display apparatus comprising a display section having a plurality of pixels, a variation detecting section which detects a display variation in each pixel, and a correction section which corrects the display variation, wherein each of the plurality of pixels comprises an electroluminescence element and an element driving transistor which is connected to the electroluminescence element, the variation detecting section detects an ON-OFF current difference between a current flowing through the electroluminescence element corresponding to an inspection OFF display signal which sets the electroluminescence element to a non-emission level and a current flowing through the electroluminescence element corresponding to an inspection ON display signal which sets the electroluminescence element to an emission level when the inspection OFF display signal and the inspection ON display signal are supplied, and compares the detected ON-OFF current difference to a reference value, and the correction section corrects a data signal to be supplied to each pixel based on a result of the comparison.

According to another aspect of the present invention, it is preferable that the electroluminescence display apparatus further comprises a correction data storage section which stores correction data corresponding to the ON-OFF current difference, wherein the correction section corrects the data signal based on the stored ON-OFF current difference.

According to another aspect of the present invention, it is preferable that the electroluminescence display apparatus further comprises a storage section which stores initial current difference data for the ON-OFF current difference, wherein the correction section corrects the data signal based on the initial current difference data and the detected ON-OFF current difference.

According to another aspect of the present invention, it is preferable that, in the electroluminescence display apparatus, the current flowing through the electroluminescence element is a cathode current.

According to various aspects of the present invention, an element driving transistor which is provided in each pixel and which drives an EL element is operated in a saturation region and the EL element is caused to emit light, and a current flowing through the EL element such as, for example, a cathode current in this process is measured. In an EL element, there is a correlation relationship between the current flowing through the element and the emission brightness, and, thus, a display variation among EL elements can be detected by measuring the current flowing through the EL element.

Because the measurement target is the current instead of the emission brightness, the measurement can be made with a simple structure. In addition, by switching the EL element ON and OFF and measuring the ON and OFF current values, it is possible to accurately know the ON current with the OFF current as a reference, which facilitates accurate and rapid measurement and correction processes.

Moreover, by providing a function to measure a current flowing through the EL element in a display apparatus, occurrence of a display unevenness at a later time can be handled and corrected.

BRIEF DESCRIPTION OF THE DRAWINGS

A preferred embodiment of the present invention will be described in detail by reference to the drawings, wherein.

DESCRIPTION OF THE PREFERRED EMBODIMENT

A preferred embodiment of the present invention (hereinafter referred to as "embodiment") will now be described with reference to the drawings.

[Detection Principle]

Figure 1:
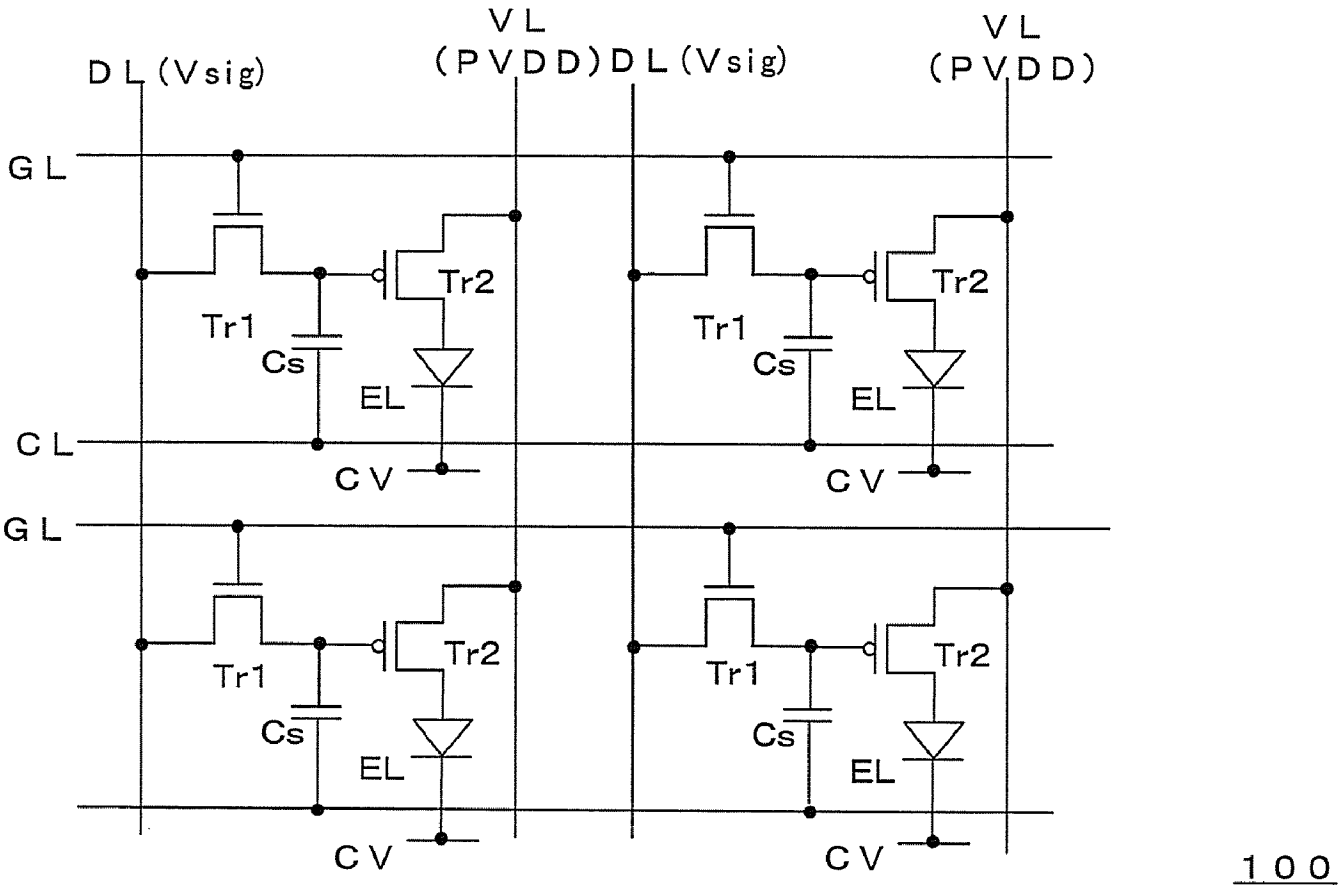
FIG. 1 is an equivalent circuit diagram for explaining a schematic circuit structure of an EL display apparatus according to a preferred embodiment of the present invention.

In the embodiment, a display apparatus is an active matrix organic electroluminescence (EL) display apparatus, and a display section having a plurality of pixels is formed on an EL panel 100. FIG. 1 is a diagram showing an equivalent circuit structure of an active matrix EL display apparatus according to the embodiment. A plurality of pixels are arranged in the display section of the EL panel 100 in a matrix form, a selection line GL on which a selection signal is sequentially output is formed along a horizontal scan direction (row direction) of the matrix, and a data line DL on which a data signal (Vsig) is output and a power supply line VL for supplying a drive power supply PVDD to an organic EL element (hereinafter simply referred to as "EL element") which is an element to be driven are formed along a vertical scan direction (column direction).

Each pixel is provided in a region approximately defined by these lines. Each pixel comprises an EL element as an element to be driven, a selection transistor Tr1 formed by an n-channel TFT (hereinafter referred to as "selection Tr1"), a storage capacitor Cs, and an element driving transistor Tr2 formed by a p-channel TFT (hereinafter referred to as "element driving Tr2").

The selection Tr1 has a drain connected to the data line DL which supplies a data voltage (Vsig) to the pixels along the vertical scan direction, a gate connected to the gate line GL which selects pixels along a horizontal scan line, and a source connected to a gate of the element driving Tr2.

A source of the element driving Tr2 is connected to the power supply line VL and a drain of the element driving Tr2 is connected to an anode of the EL element. A cathode of the EL element is formed common for the pixels and is connected to a cathode power supply CV.

The EL element has a diode structure and comprises a light emitting element layer between a lower electrode and an upper electrode. The light emitting element layer comprises, for example, at least a light emitting layer having an organic light emitting material, and a single layer structure or a multilayer structure of 2, 3, or 4 or more layers can be employed for the light emitting element layer depending on characteristics of the materials to be used in the light emitting element layer or the like. In the present embodiment, the lower electrode is patterned into an individual shape for each pixel, functions as the anode, and is connected to the element driving Tr2. The upper electrode is common to a plurality of pixels and functions as the cathode.

In an active matrix EL display apparatus having the circuit structure as described above in each pixel, if an operation threshold value Vth of the element transistor Tr2 varies, even when a same data signal is supplied to the pixels, the same current is not supplied from the drive power supply PVDD to the EL element, which causes brightness variation (display variation).

Figures 2A, 2B:
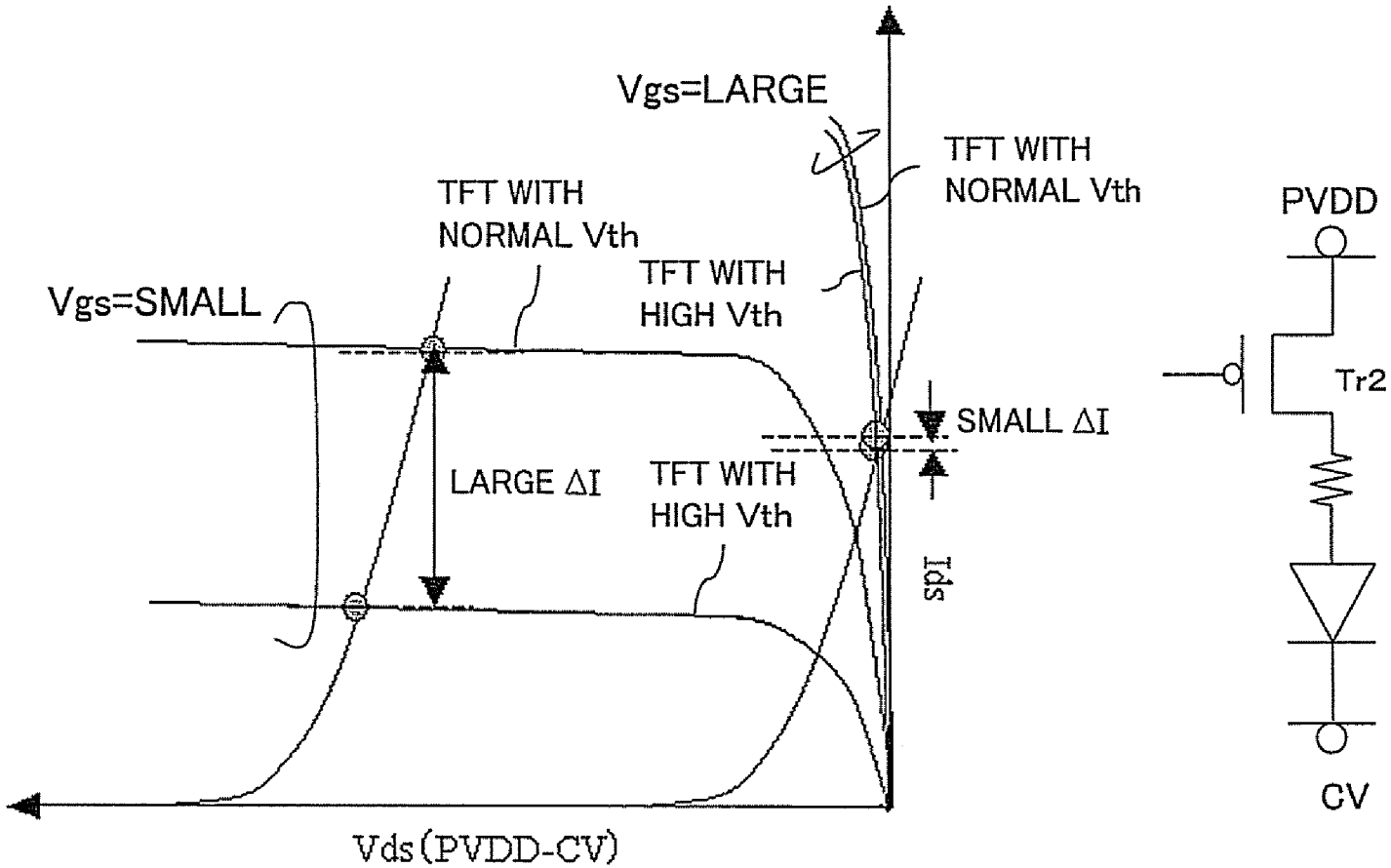
FIGS. 2A and 2B are diagrams for explaining a principle of measurement of a characteristic variation of an element driving transistor according to a preferred embodiment of the present invention.

FIG. 2B shows an equivalent circuit of a pixel and IV characteristics of the element driving Tr2 and the EL element when a characteristic variation occurs in the element driving Tr2 (variation in a current supplying characteristic; for example, variation in the operation threshold value Vth). When the operation threshold value Vth of the element driving Tr2 varies, the circuit can be considered as having a resistance which is larger or smaller than that in the normal case is connected to a drain side of the element driving Tr2 as shown in FIG. 2B. Therefore, although the characteristic of the current (in the present embodiment, cathode current ICV) flowing through the EL element is not different from that of the normal pixel, the current actually flowing through the EL element would vary according to a characteristic variation of the element driving Tr2.

When a voltage applied to the element driving Tr2 satisfies a condition of Vgs−Vth<Vds, the element driving Tr2 operates in a saturation region. In a pixel having the operation threshold value Vth of the element driving Tr2 which is higher than that for a normal pixel, the current Ids between the drain and the source of the transistor is smaller than that for a normal transistor and an amount of supplied current to the EL element, that is, the current flowing through the EL element is smaller than that for a normal pixel (a large ΔI), as shown in FIG. 2A. As a result, the emission brightness of the pixel is reduced compared to the emission brightness of the normal pixel and a display variation occurs.

On the other hand, in a pixel having an operation threshold value Vth of the element driving Tr2 which is smaller compared to that of the normal pixel, the current Ids between the drain and the source of the transistor is larger than that of a normal transistor, the current flowing through the EL element is larger than that of the normal pixel, and the emission brightness is higher.

When a voltage applied to the element driving Tr2 satisfies a condition of Vgs−Vth>Vds, the element driving Tr2 operates in a linear region. In the linear region, a difference in the Ids−Vds characteristic between an element driving Tr2 having a higher threshold value Vth and an element driving Tr2 having a lower threshold value Vth is small, and, thus, a difference in the amount of supplied current to the EL element (ΔI) is also small. Because of this, the EL elements show similar emission brightness regardless of the presence or absence of the characteristic variation in the element driving Tr2, and, thus, it is difficult to detect a display variation caused by the characteristic variation in the linear region. By operating the element driving Tr2 in the saturation region as described above, it is possible to detect the display variation caused by the characteristic variation in the element driving Tr2.

The display variation can be reliably corrected by correcting the data signal to be supplied to each pixel based on the detected current value. For example, when the threshold value |Vth| of the element driving Tr2 is smaller than that of a normal pixel, the emission brightness of the EL element when a reference data signal is supplied is higher than that of the normal pixel. Therefore, in this case, the brightness variation can be corrected by reducing the absolute value |Vsig| of the data signal according to a shift of the threshold value |Vth| with respect to the reference. When, on the other hand, the threshold value |Vth| of the element driving Tr2 is higher than that of a normal pixel, the brightness variation can be corrected by increasing the absolute value |Vsig| of the data signal according to the shift of the threshold value |Vth| with respect to the reference.

In the above-described circuit structure, a p-channel TFT is employed as the element driving transistor. However, the present invention is not limited to such a configuration, and, alternatively, an n-channel TFT may be used. In addition, although in the above-described pixel circuit, an example structure is described in which two transistors including a selection transistor and a driving transistor are employed as transistors in a pixel, the present invention is not limited to a structure with two transistors or to the above-described circuit structure.

[Concrete Example]

An inspection of a cathode current and a display variation correction according to the above-described principle will now be described with reference to FIGS. 3-5.

Figure 3:
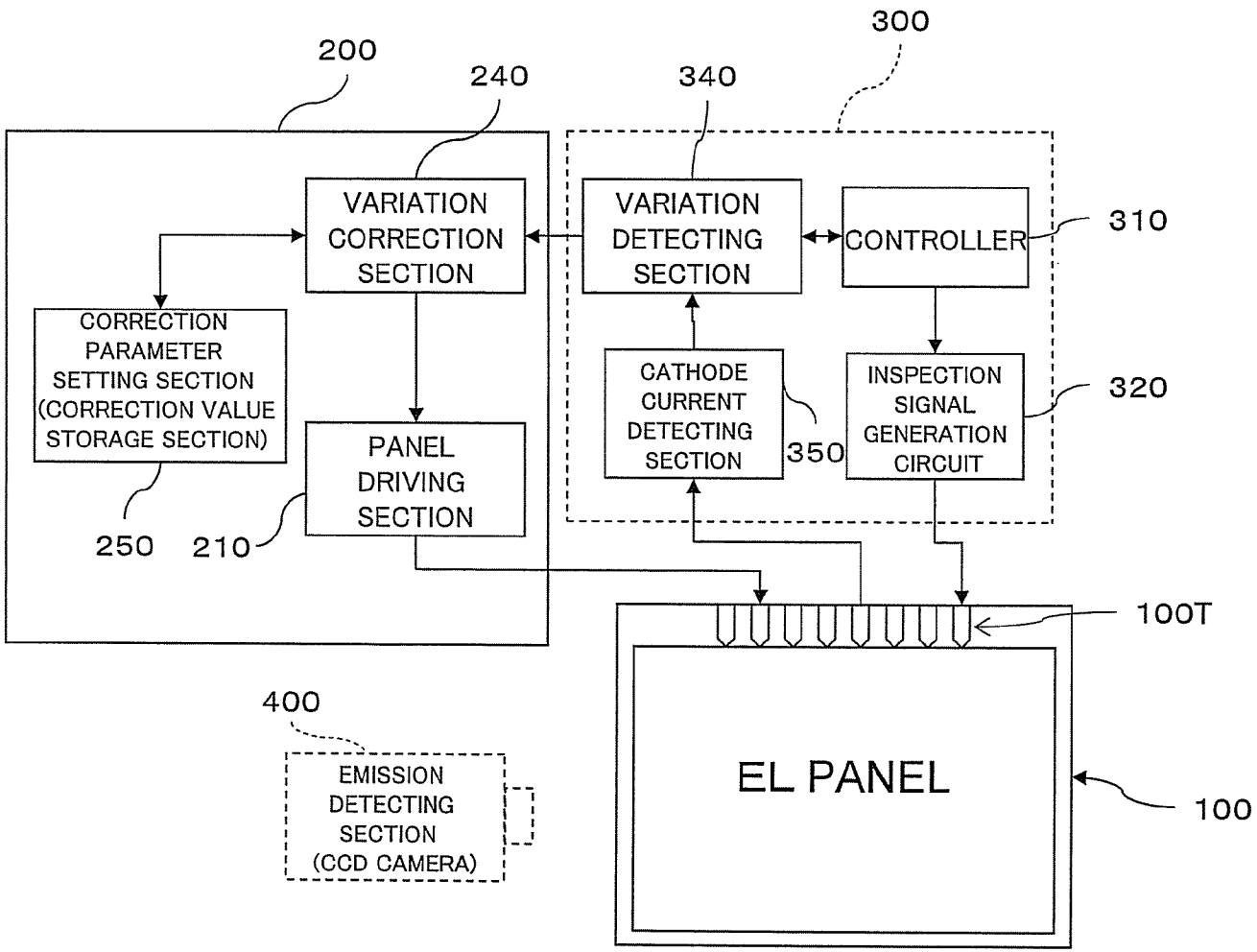
FIG. 3 is a diagram schematically showing a structure of an EL display apparatus and a structure of a cathode current inspection apparatus according to a preferred embodiment of the present invention.

FIG. 3 schematically shows a structure of an apparatus which measures a cathode current and corrects a brightness variation. A current inspection section 300 is provided as an inspection apparatus for inspecting a display variation in the EL panel 100 based on a measurement of the cathode current at the time of shipping from a factory. An inspection signal generation circuit 320 generates an inspection power supply, an inspection timing signal, a display signal, etc. necessary for the inspection and supplies through a terminal 100T to the EL panel 100 under a control by a controller 310. A variation detecting section 340 detects whether or not there is an occurrence of a display variation based on a cathode current Icv detected by a cathode current detecting section 350.

An EL panel driving apparatus 200 forms a part of an EL display apparatus along with the EL panel 100, and comprises a panel driving section 210 which drives the EL panel 100, a correction value storage section (correction parameter setting section) 250, and a variation correction section 240 which corrects a data signal using a correction value stored in the correction value storage section 250 at the time of shipping from factory.

Figure 4:
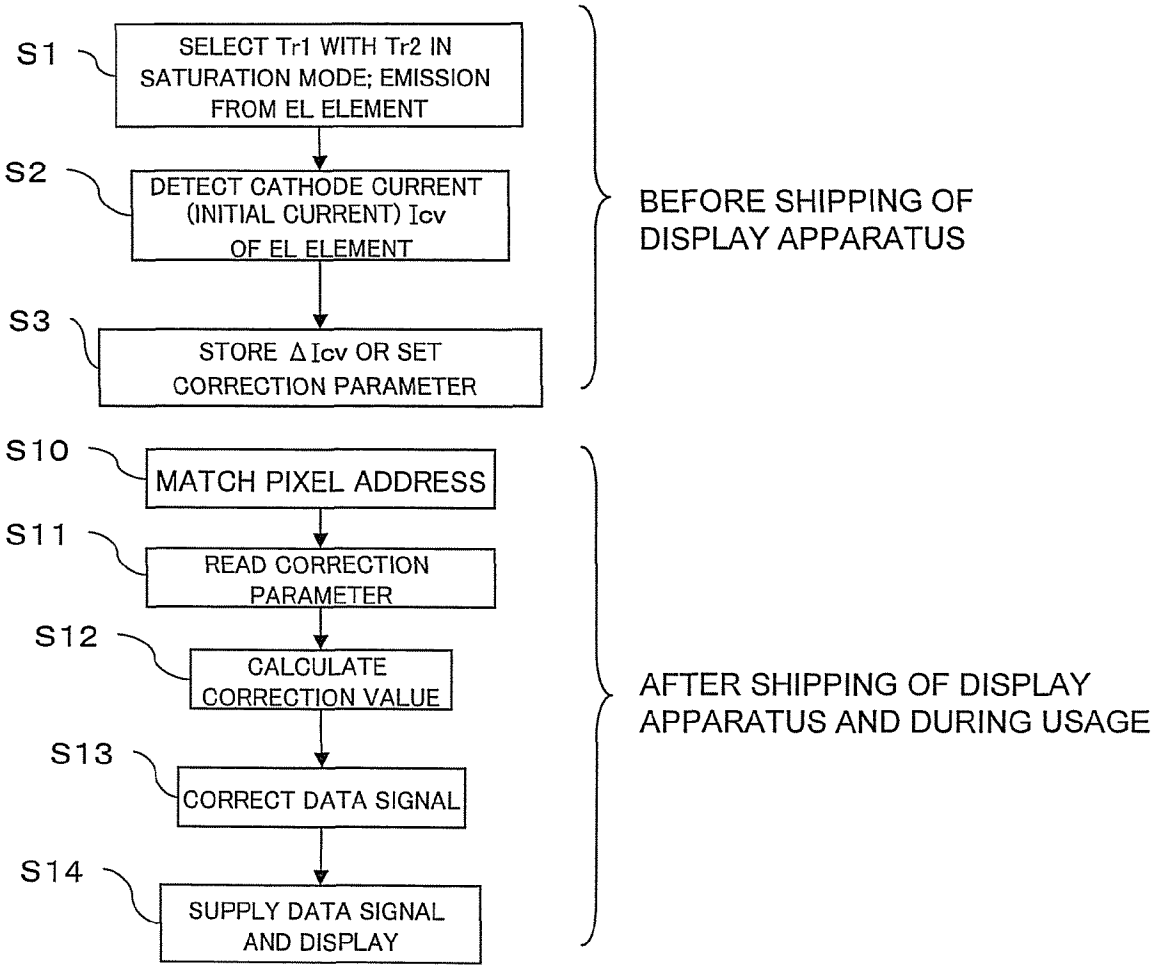
FIG. 4 is a diagram showing an example of an emission state inspection process using an inspection apparatus of FIG. 3.

FIG. 4 shows an example of a process of measuring a cathode current and correcting a display variation. Prior to the shipping of the display apparatus, the selection Tr1 of each pixel is switched ON with a signal from the inspection signal generation circuit 320 of the current inspection section 300 and an inspection ON display signal is applied to the gate of the element driving Tr2 through the selection Tr1 of the corresponding pixel (S1).

During this process, the element driving Tr2 is operated in the saturation region; that is, the element driving Tr2 is set to satisfy the above-described condition of Vgs−Vth<Vds. When a p-channel TFT is employed as the element driving Tr2, the voltage is similar to that in the normal display mode. For example, the drive power supply PVDD may be 8.0 V, a cathode power supply CV may be −3 V, and a signal of 0 V may be used as the inspection ON display signal to be supplied to each pixel.

The cathode current detecting section 350 detects the cathode current Icv when the element driving Tr2 of the corresponding pixel is operated in the saturation region and the EL element is caused to emit light (S2). The variation detecting section 340 compares the detected cathode current Icv to a reference value (reference range). The variation detection section 340 then determines, when the cathode current is greater than the reference value, a correction value necessary for increasing the voltage of the data signal to be supplied to the EL panel 100 and reducing the current flowing through the EL element, and determines, when the cathode current is smaller than the reference range, a correction value necessary for reducing the voltage of the data signal and increasing the current flowing through the EL element. The correction value is stored in the storage section 250 as a correction value for each pixel (S3). Depending on the functions of the variation correction section 240 of the EL panel driving apparatus 200, the storage section 250 may store a parameter necessary for the correction and the measured cathode current value for each pixel (initial cathode current value), in place of directly storing the correction value. When, as a result of the comparison between the cathode current Icv and the reference value in the variation detecting section 340, it is determined that the cathode current Icv is greater than or smaller than the reference value in a degree exceeding an allowable range, it is determined that the panel cannot be corrected even if the data signal is corrected; that is, it is determined that a display defect occurred. The panel can be sent to a repairing process if repairing is possible.

In the case where an n-channel TFT is used as the element driving Tr2, the detected cathode current Icv is compared to a reference value, and, when the cathode current is greater than the reference value, a correction value necessary for reducing the voltage of the data signal to be supplied to the EL panel 100 and increasing the current flowing through the EL element is determined, and, when, on the other hand, the cathode current is smaller than the reference value, a correction value necessary for increasing the voltage of the data signal to be supplied to the EL panel 100 and reducing the current flowing through the EL element is determined.

A correction value is stored in the storage section 250 in this manner, and, an EL display apparatus on which other inspections are executed and which is ultimately determined as a non-defective display apparatus is shipped. The EL display apparatus realizes a display while correcting the data signal during the operation.

When a video signal supplied from outside is processed and a data signal for each pixel is supplied to the EL panel 100, the variation correction section 240 determines whether or not the pixel address of the data signal corresponds to a pixel which requires correction. When the addresses match, that is, when the pixel is a pixel which requires a correction (S10), correction information such as a correction parameter is read from the storage section 250 (S11), and a correction value for the data signal is calculated (S12).

The data signal to be supplied is corrected by multiplying, for example, the calculated correction value and the data signal to be supplied (S13), the data signal (Vsig) is supplied to the corresponding pixel through the data line DL of the EL panel 100 shown in FIG. 1, the EL element emits light with a brightness corresponding to the corrected data signal, and display is realized (S14).

(Rapid Measurement of Cathode Current)

Figure 5:
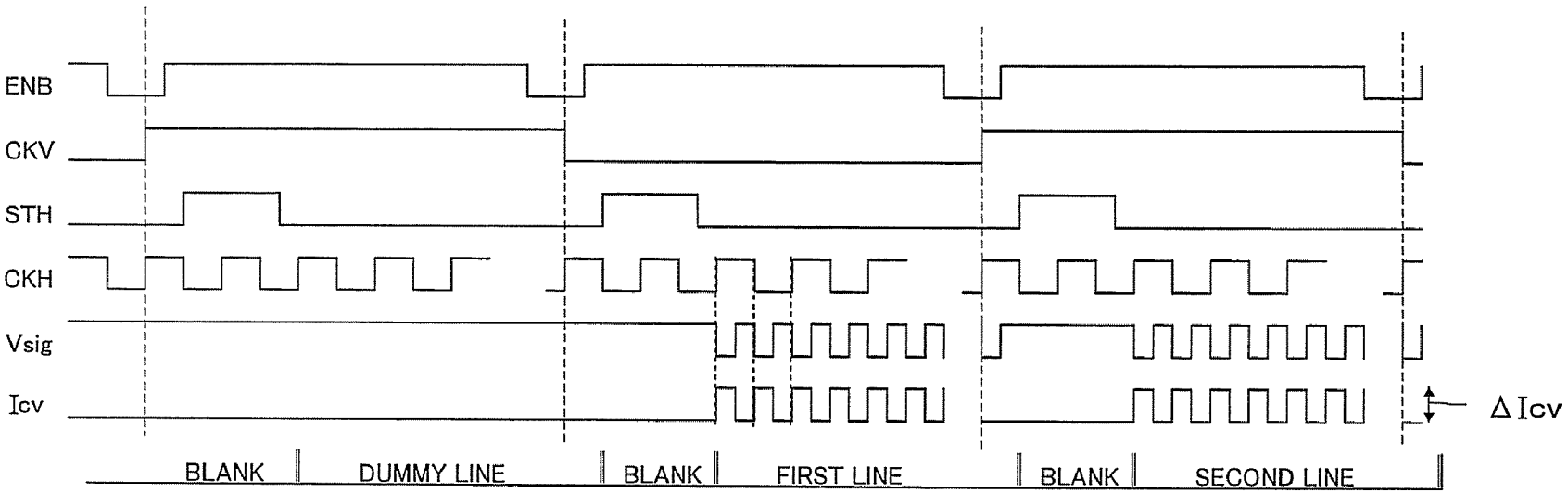
FIG. 5 is a diagram showing a drive waveform for executing a rapid inspection based on the cathode current.

FIG. 5 shows a drive waveform of the EL panel 100 when a display variation is rapidly inspected based on the cathode current Icv. In the inspection method of FIG. 5, an ON display signal (EL emission) and an OFF display signal (EL non-emission) are consecutively applied as the inspection display signal Vsig to the corresponding pixel in a period in which a pixel is selected (a half period of a horizontal clock signal). The inspection display signal is generated by the inspection signal generation circuit 320 of FIG. 3 based on a horizontal start signal STH, a horizontal clock signal CKH, etc. The cathode current detecting section 350 detects a cathode current $Icv_{on}$ of the EL element corresponding to the ON display signal and a cathode current $Icv_{off}$ of the EL element corresponding to the OFF display signal (and amplifies the current as necessary). The variation detecting section 340 determines a difference ΔIcv of the ON and OFF cathode currents, and compares the difference data to, for example, a reference value based on difference data in a normal pixel, so that the display variation can be detected.

In the inspection method of FIG. 5 also, the drive power supply PVDD and the cathode power supply CV are set so that the element driving Tr2 operates in the saturation region as described above. In addition, in FIG. 5, the vertical clock signal CKV is a clock signal corresponding to a number of pixels along the vertical direction and the enable signal ENB is a prohibiting signal for preventing, at the start and end of a horizontal scan period, output of a selection signal to each horizontal scan line (gate line GL) before the display signal Vsig is fixed.

In this manner, by measuring the cathode current $Icv_{off}$ corresponding to the OFF display signal and relatively understanding the cathode current $Icv_{on}$ corresponding to the ON display signal with the $Icv_{off}$ as a reference, it becomes no longer necessary to accurately determine the absolute value of the cathode current $Icv_{on}$ corresponding to the ON display signal and to separately measure the cathode current $Icv_{off}$ which forms a reference and which corresponds to the OFF display signal, and, thus, a rapid automatic inspection can be executed with a high precision. More specifically, for example, for each pixel of R, G, and B, the cathode current can be measured within a time of less than approximately 3 sec. and very rapid inspection is enabled. The inspection time can be significantly shortened compared to, for example, a method in which the EL element is caused to emit light, an image of the emission is captured, and the brightness is analyzed based on the captured image data. Moreover, the display variation can be detected for all pixels. When it is necessary to reduce the capacity of the correction value storage section 250, it is possible to set the unit of the measurement target of the cathode current to a plurality of pixels and store the correction value in units of a plurality of pixels (a region). In this case, the variation correction section 240 can, for example, determine a correction value for a pixel of interest by linearly interpolating correction values of a plurality of adjacent pixel regions.

In addition, in the inspection method of FIG. 5, a horizontal start signal STH which determines a period in which the display signal is to be output along the column direction of the pixels arranged in a matrix, that is, on the data line DL is set to a selection period of two columns. During the normal display, the pixels on each horizontal scan line are selected for a corresponding 1 H period, and the display signal Vsig is output on the corresponding data line DL for each period corresponding to a period in which the 1 H period is divided by the number of pixels on one horizontal scan line. By using the inspection horizontal start signal STH during the variation inspection, on the other hand, the inspection display signal Vsig is supplied for a display signal output period corresponding to two pixels on one data line DL. In other words, for the pixels along the same horizontal scan line, two adjacent pixels are set as the inspection target at the same time. The number of simultaneous inspection target pixels is not limited to two and, for example, three pixels may be simultaneously inspected. By setting a pixel to be an inspection target consecutively for a plurality of times, an erroneous detection due to noise can be reduced even when the noise is superposed to the timing signal, the inspection display signal Vsig, or the like and erroneous display is realized in the pixel, because a probability that such noise superposition occurs consecutively for a plurality of periods is low.

Among the driving circuits for driving each pixel in the display section of the EL panel 100, a horizontal direction driving circuit comprises a shift register having stages with a number of stages corresponding to a number of pixels along the horizontal scan direction. The shift register sequentially transfers a horizontal start signal STH according to a horizontal clock signal CKH and a sampling and holding signal which determines a period in which the display signal Vsig is to be output to the corresponding data line DL (sampling period) is output from each stage of the register to a sampling circuit. A sampling period indicated by the sampling and holding signal corresponds to the period of the horizontal start signal STH (here, H level period). Thus, by supplying, during the defect inspection and to the horizontal direction driving circuit of the EL panel 100, an inspection horizontal start signal STH generated by the inspection signal generation circuit 320 and as shown in FIG. 5 as a horizontal start signal STH and supplying the inspection display signal Vsig as shown in FIG. 5 to a video signal line connected to each data line DL through the sampling circuit, it is possible to supply the inspection display signal Vsig for each group of a plurality of pixels, and inspection can be executed.

The driving method of FIG. 5 is effective for a structure having a pixel circuit in which the ON and OFF timings of the element driving Tr2 (emission and non-emission of EL element) are set in connection with the switching timing of the drive waveform of the display signal supplied to the data line DL, and may be applied, for example, to a pixel circuit structure as shown in FIG. 1. Even in a pixel circuit structure in which a desired AC signal is supplied on a capacitor line CL which controls a potential of the storage capacitor Cs of each pixel, the inspection method of FIG. 5 may be employed by adding elements such as a capacitor potential control switch which fixes a potential of the capacitor line CL during the inspection and operating the element driving Tr2 according to the timing of the display signal supplied to the data line DL.

(Display Apparatus with Display Variation Measuring Function)

Figure 6:
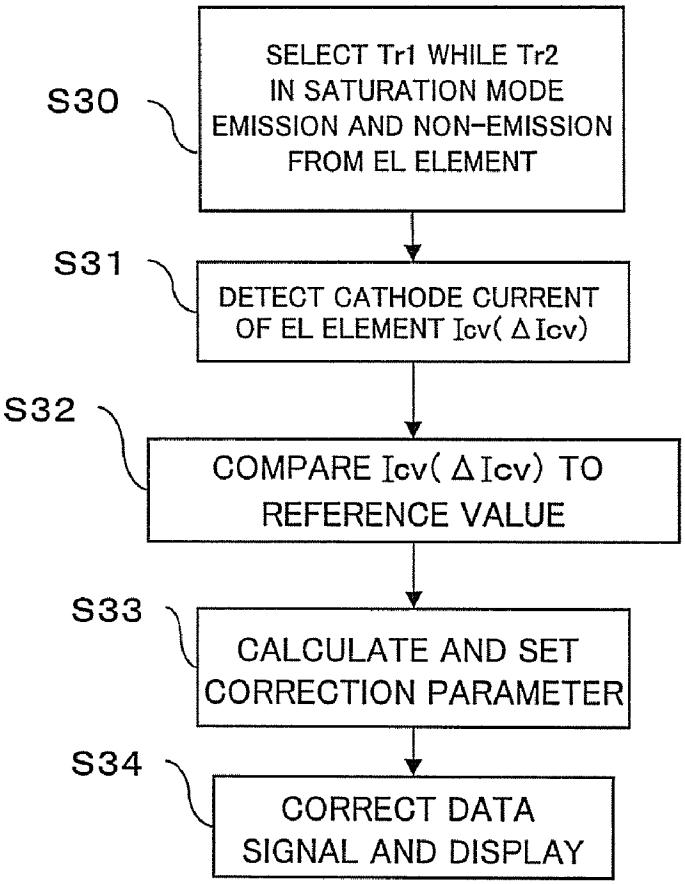
FIG. 6 is a diagram showing an example of an operation process of an EL display apparatus having a cathode current detection function and a correction function according to a preferred embodiment of the present invention.

In the above description, a method in which a cathode current is measured and a correction value is stored in advance during shipping from a factory has been described. Alternatively, it is also possible to provide the cathode current measuring function (display variation measuring function) on the EL display apparatus. An EL display apparatus having a display variation measuring function and a correction function will now be described with reference to FIG. 6.

The EL display apparatus is realized by providing the current inspection section 300 of FIG. 3 along with the EL panel 100 and the EL panel driving apparatus 200. For example, as shown in FIG. 5, an inspection OFF display signal which sets the EL element to a non-emission level and an inspection ON display signal which sets the EL element to an emission level are supplied from the inspection signal generation circuit 320 of the current inspection section 300, and a cathode current difference ΔIcv between a time when the inspection OFF display signal is supplied and a time when the inspection ON display signal is supplied is measured. The cathode current measurement is preferably executed in a period other than the normal operation period such as, for example, during startup of the apparatus and standby period of the apparatus.

The cathode current measurement method is similar to that of FIG. 5. That is, the element driving Tr2 is set to the saturation mode by switching the selection Tr1 ON, an inspection ON display signal and an inspection OFF display signal are applied (S30), the cathode current detecting section 350 detects a cathode current, and the variation detecting section 340 detects a cathode current difference ΔIcv (S31).

The variation detecting section 340 then compares the cathode current difference ΔIcv to a reference value (reference range) (S32), and determines a correction value according to the result of the comparison (S33). When the cathode current difference ΔIcv is within the reference range, the pixel is a normal pixel (with no display variation), and, thus, the variation correction section 240 selects a parameter which sets the amount of correction to 0 for the pixel. When, on the other hand, the cathode current difference ΔIcv is not in the reference range, a display variation is present, and, thus, a correction parameter according to a difference from the reference value is calculated. The correction parameter calculated in this manner is set to the correction value storage section 250. During the normal display, the variation correction section 240 executes a necessary correction of a data signal for a pixel based on the set correction parameter similar to the process of usage after the apparatus is shipped as shown in FIG. 4 (S10-S14) and supplies the data signal so that a display is realized (S34).

By providing a cathode current measurement function on the display apparatus in this manner, even when a characteristic variation occurs in the element driving Tr2 or the like because of a change with elapse of time after shipping, the data signal can be corrected according to the change, the display quality can be maintained for a long period of time, and a lifetime as a display apparatus can be improved.

By measuring a same cathode current difference ΔIcv at the initial state (when shipped) and storing the measured value as a reference value in the storage section 250 at the time of shipping from factory, the change with elapse of time of the characteristic caused by the usage can be more accurately detected, and the correction calculation can be executed in consideration of the change with elapse of time.

In the above description, an example configuration in which the cathode current difference ΔIcv is measured when a cathode current measurement function is provided in the EL display apparatus has been described. Alternatively, it is also possible to employ a configuration in which a cathode current when only the inspection ON display signal is supplied to each pixel is measured during display variation detection after shipping, a predetermined reference value (for example, initial cathode current) is stored in advance, and the measured cathode current is compared to the reference value.

In the above description, a method of measuring a cathode current is described as the method of detecting a display variation during shipping and after shipping. Regarding the display variation detection at the time of shipping, a method may be employed as shown by a dotted line in FIG. 3, in which the EL element is caused to emit light, emission brightness is detected using a camera 400 which captures an image of the emission of the EL element, and the correction value is calculated based on the brightness. Then, after the shipping, the cathode current may be detected by the current inspection section 300, and the data signal may be further corrected.

In the correction in the variation correction section 240 described above, the calculation process and correction process method are not limited as long as the data signal supplied to a pixel in which the display variation occurs is adjusted to a suitable level and the emission brightness of the EL element is corrected.

By integrating, along with the panel driving section 210, the variation correction section 240 and the current inspection section 300 when the current inspection section 300 is to be built in a display apparatus, it is possible to provide a display apparatus which can execute detection and correction of display variation with a very small driving circuit.

By employing a configuration, for the correction value storage section 250, in which the cathode current value (ΔIcv) detected by the current inspection section 300 or correction information is rewritable or is sequentially added, it is possible to realize a display apparatus permanently having no display unevenness.

Although in the above description, an example configuration is shown in which a cathode current (for example, ΔIcv) of the EL element is used as the current to be measured during inspection of the display variation, the inspection can be executed based on any current Ioled (ΔIoled) flowing through the EL element. As the current Ioled flowing through the EL element, for example, it is also possible to use the anode current Iano in place of the cathode current Icv. When a structure in which the cathode electrode is set as the individual electrode for each pixel of an EL element and the anode electrode is set as the electrode common to a plurality of pixels is employed in place of the structure in which the anode electrode is set as the individual electrode and the cathode electrode is set as the common electrode, the anode current (ΔIano) which is a current flowing through the common electrode may be measured.

What is claimed is:

1. A method of correcting a display variation for an electroluminescence display apparatus comprising, in each pixel, an electroluminescence element having a diode structure and an element driving transistor which is connected to the electroluminescence element and which controls a current flowing through the electroluminescence element, the method comprising:

supplying an inspection ON display signal which sets the electroluminescence element to an emission level to each pixel;

operating the element driving transistor in a saturation region; and detecting a current flowing through the electroluminescence element while the element driving transistor is operated in the saturation region;

wherein a data signal to be supplied to a corresponding pixel is corrected based on a value of the current flowing through the electroluminescence element, wherein the current flowing through the electroluminescence element is a cathode current;

wherein the driving transistor is configured to receive the data signal at a gate electrode and configured to control a current through the organic element in accordance with a voltage of the data signal;

the cathode current is measured when one of the EL elements is set at the emission level by the inspection ON display signal as the data signal;

the correction data for each pixel is obtained based on the measured cathode current by alternatively setting the one of the EL elements at the emission level;

the correction data for each pixel is stored in a memory;

the correction data for each pixel is used for correcting the data signal for each pixel;

the corrected data signal for each pixel is supplied to the gate electrode of the driving transistor of a corresponding pixel;

a plurality of adjacent pixels are set as the inspection target, at the same time the plurality of the adjacent pixels are in a same horizontal scan line; and a pixel of the plurality of adjacent pixels is set to be an inspection target consecutively for a plurality of times.

2. A method of correcting a display variation for an electroluminescence display apparatus comprising, in each pixel, an electroluminescence element having a diode structure and an element driving transistor which is connected to the electroluminescence element and which controls a current flowing through the electroluminescence element, the method comprising:

operating the element driving transistor of each pixel in a saturation region; and supplying an inspection ON display signal which sets the electroluminescence element to an emission level and an inspection OFF display signal which sets the electroluminescence element to a non-emission level to each pixel;

detecting an ON-OFF current difference between a current flowing through the electroluminescence element corresponding to the inspection ON display signal and a current flowing through the electroluminescence element corresponding to the inspection OFF display signal while the element driving transistor is operated in the saturation region;

the ON-OFF current difference is compared to a reference value and a characteristic variation of an operated pixel is detected, wherein the current flowing through the electroluminescence element is a cathode current; and a data signal to be supplied to a corresponding pixel is corrected based on the detected characteristic variation;

wherein the driving transistor is configured to receive the data signal at a gate electrode and configured to control a current through the organic element in accordance with a voltage of the data signal;

the cathode current is measured when one of the EL elements is set at the emission level by the inspection ON display signal as the data signal;

the correction data for each pixel is obtained based on the measured cathode current by alternatively setting the one of the EL elements at the emission level;

the correction data for each pixel is stored in a memory;

the correction data for each pixel is used for correcting the data signal for each pixel;

the corrected data signal for each pixel is supplied to the gate electrode of the driving transistor of a corresponding pixel;

a plurality of adjacent pixels are set as the inspection target, at the same time the plurality of the adjacent pixels are in a same horizontal scan line; and a pixel of the plurality of adjacent pixels is set to be an inspection target consecutively for a plurality of times.

3. An electroluminescence display apparatus comprising:

a display section having a plurality of pixels;

a correction data storage section which stores correction data for correcting a display variation; and a correction section which corrects the display variation, wherein each of the plurality of pixels comprises an electroluminescence element and an element driving transistor which is connected to the electroluminescence element;

the correction data storage section stores correction data for each pixel corresponding to a current flowing through the corresponding electroluminescence element when an inspection ON display signal which sets the corresponding electroluminescence element to an emission level is supplied while the corresponding element driving transistor is operated in a saturation region, wherein the current flowing through the electroluminescence element is a cathode current; and the correction section corrects a data signal to be supplied to each pixel based on the correction data;

wherein the driving transistor is configured to receive the data signal at a gate electrode and configured to control a current through the organic element in accordance with a voltage of the data signal;

the cathode current is measured when one of the EL elements is set at the emission level by the inspection ON display signal as the data signal;

the correction data for each pixel is obtained based on the measured cathode current by alternatively setting the one of the EL elements at the emission level;

the correction data for each pixel is stored in a memory;

the correction data for each pixel is used for correcting the data signal for each pixel;

the corrected data signal for each pixel is supplied to the gate electrode of the driving transistor of a corresponding pixel;

a plurality of adjacent pixels are set as the inspection target, at the same time the plurality of the adjacent pixels are in a same horizontal scan line; and a pixel of the plurality of adjacent pixels is set to be an inspection target consecutively for a plurality of times.

4. An electroluminescence display apparatus comprising:

a display section having a plurality of pixels;

a correction data storage section which stores correction data for correcting a display variation; and a correction section which corrects the display variation, wherein each of the plurality of pixels comprises an electroluminescence element and an element driving transistor which is connected to the electroluminescence element;

the correction data storage section stores correction data for each pixel corresponding to an ON-OFF current difference between a current flowing through the corresponding electroluminescence element corresponding to an inspection OFF display signal which sets the corresponding electroluminescence element to a non-emission level;

and a current flowing through the corresponding electroluminescence element corresponding to an inspection ON display signal which sets the corresponding electroluminescence element to an emission level when the inspection OFF display signal and the inspection ON display signal are supplied while the corresponding element driving transistor is operated in a saturation region, wherein the current flowing through the electroluminescence element is a cathode current; and the correction section corrects a data signal to be supplied to each pixel based on the correction data;

wherein the driving transistor is configured to receive the data signal at a gate electrode and configured to control a current through the organic element in accordance with a voltage of the data signal;

the cathode current is measured when one of the EL elements is set at the emission level by the inspection ON display signal as the data signal;

the correction data for each pixel is obtained based on the measured cathode current by alternatively setting the one of the EL elements at the emission level;

the correction data for each pixel is stored in a memory;

the correction data for each pixel is used for correcting the data signal for each pixel;

the corrected data signal for each pixel is supplied to the gate electrode of the driving transistor of a corresponding pixel;

a plurality of adjacent pixels are set as the inspection target, at the same time the plurality of the adjacent pixels are in a same horizontal scan line; and a pixel of the plurality of adjacent pixels is set to be an inspection target consecutively for a plurality of times.

5. An electroluminescence display apparatus comprising:

a display section having a plurality of pixels, a variation detecting section which detects a display variation in each pixel; and a correction section which corrects the display variation, wherein each of the plurality of pixels comprises an electroluminescence element and an element driving transistor which is connected to the electroluminescence element;

the variation detecting section detects an ON-OFF current difference for each pixel between a current flowing through the corresponding electroluminescence element corresponding to an inspection OFF display signal which sets the corresponding electroluminescence element to a non-emission level; and a current flowing through the corresponding electroluminescence element corresponding to an inspection ON display signal which sets the corresponding electroluminescence element to an emission level when the inspection OFF display signal; and the inspection ON display signal are supplied while the corresponding element driving transistor is operated in a saturation region, and compares the detected ON-OFF current difference to a reference value, wherein the current flowing through the electroluminescence element is a cathode current; and the correction section corrects a data signal to be supplied to each pixel based on a result of the comparison;

wherein the driving transistor is configured to receive the data signal at a gate electrode and configured to control a current through the organic element in accordance with a voltage of the data signal;

the cathode current is measured when one of the EL elements is set at the emission level by the inspection ON display signal as the data signal;

the correction data for each pixel is obtained based on the measured cathode current by alternatively setting the one of the EL elements at the emission level;

the correction data for each pixel is stored in a memory;

the correction data for each pixel is used for correcting the data signal for each pixel;

the corrected data signal for each pixel is supplied to the gate electrode of the driving transistor of a corresponding pixel;

a plurality of adjacent pixels are set as the inspection target, at the same time the plurality of the adjacent pixels are in a same horizontal scan line; and a pixel of the plurality of adjacent pixels is set to be an inspection target consecutively for a plurality of times.

6. The electroluminescence display apparatus according to claim 5, further comprising:

a storage section which stores initial current difference data for the ON-OFF current difference, wherein the correction section corrects the data signal based on the initial current difference data and the detected ON-OFF current difference.

7. The electroluminescence display apparatus according to claim 5, further comprising:

a correction data storage section which stores correction data corresponding to the ON-OFF current difference, wherein the correction section corrects the data signal based on the stored ON-OFF current difference.

8. The electro luminescence display apparatus according to claim 7, further comprising:

a storage section which stores initial current difference data for the ON-OFF current difference, wherein the correction section corrects the data signal based on the initial current difference data and the detected ON-OFF current difference.

* * * * *